US007934616B2

(12) United States Patent
Felber

(10) Patent No.: US 7,934,616 B2
(45) Date of Patent: May 3, 2011

(54) FLIP-TOP CLOSURE FOR COMPOSITE AND CARDBOARD PACKAGING

(75) Inventor: Josef Felber, Zollikon (CH)

(73) Assignee: SIG Technology Ltd., Neuhausen Am Rheinfall (CH)

( * ) Notice: Subject to any disclaimer, the term of this patent is extended or adjusted under 35 U.S.C. 154(b) by 1160 days.

(21) Appl. No.: 10/598,008

(22) PCT Filed: Feb. 16, 2005

(86) PCT No.: PCT/CH2005/000089

§ 371 (c)(1),
(2), (4) Date: Aug. 21, 2006

(87) PCT Pub. No.: WO2005/077769

PCT Pub. Date: Aug. 25, 2005

(65) Prior Publication Data

US 2007/0131689 A1 Jun. 14, 2007

(30) Foreign Application Priority Data

Feb. 18, 2004 (CH) ..... 0256/04

(51) Int. Cl.
*B65D 43/18* (2006.01)

(52) U.S. Cl. ..... 220/259.2; 220/254.3; 220/255; 220/258.3; 220/258.4; 220/267; 222/83; 222/541.2; 222/546; 222/556; 229/125.04; 229/125.08; 229/125.09; 229/125.14; 229/204

(58) Field of Classification Search ..... 220/254.3, 220/255.1, 258.3, 258.4, 259.2, 267; 222/83, 222/541.2, 546, 556; 229/125.04, 125.09, 229/125.14, 204
See application file for complete search history.

(56) References Cited

U.S. PATENT DOCUMENTS 4,934,590 A * 6/1990 Robichaud et al. ..... 229/125.09

FOREIGN PATENT DOCUMENTS

WO WO 01/21492 A 3/2001

* cited by examiner

*Primary Examiner* — Anthony Stashick
*Assistant Examiner* — Elizabeth Volz
(74) *Attorney, Agent, or Firm* — Edwin D. Schindler

(57) ABSTRACT

A flip-top closure for composite and cardboard packaging, which permits the automatic opening of a package by flipping open the lid of the closure, includes a frame base element, which is designed to be welded by its level underside to composite or card-board packaging, and has a continuous peripheral overhang that protrudes upwards in order to form a pouring neck with an interior opening. A cover that flips open and closes is fixed to the base element. A guide, or tongue, element is pivotally mounted on the base element extends over the interior expanse of the overhang and friction-fit elements act between the tongue, or guide, element and the cover to pivot the tongue downwardly by force when the cover is flipped open for tearing and pivoting away a piece of the packaging lying below the tongue or guide element.

8 Claims, 9 Drawing Sheets

FLIP-TOP CLOSURE FOR COMPOSITE AND CARDBOARD PACKAGING

BACKGROUND OF THE INVENTION

1. Technical Field of the Invention

Figure 1:
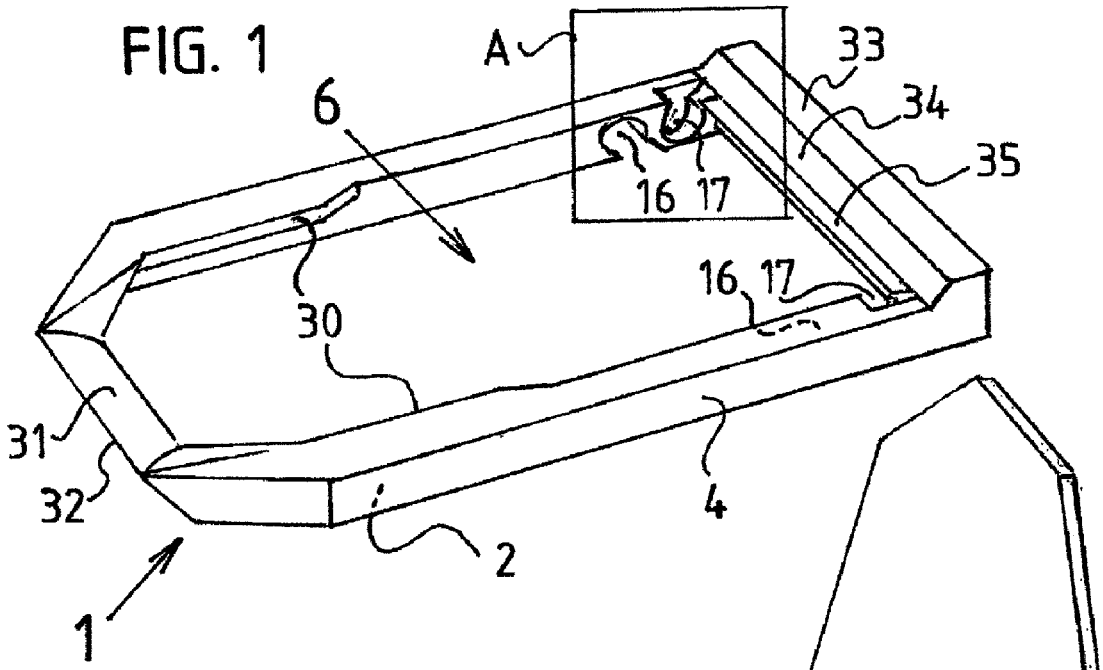

This invention relates to a flap shutter for combo packing and carton packing, in which the packing opens automatically when unfastened. This especially implies the combo packing made of foil-laminated paper, in which substances like milk, fruit juices, all kinds of non-alcoholic drinks or even non-food items such as general liquids can be packed. The closure can also be used for combo packing or carton packing, in which free-flowing substances like sugar, powder, all kinds of chemicals and similar substances can be preserved and packed. When the closure functions for such combo packing, which are produced from laminates reinforced with plastic sheeting, then it is clear that they can also be used in simple paper or carton packing, which, owing to the absence of the laminated foils, can be tom quite easily.

The foil-laminated paper in case of combo packing is a laminated material, somewhat like paper or carton paper coated with plastic such as polyethylene and/or aluminum. The membrane liner thus comprises of aluminum or plastic sheeting, which is stuck on the inside of the combo packing with the carton layer of the packing. However, it can also be made of a PE coating, which is welded on to the inner side of the carton material of the combo packing by means of a high-frequency welding. The normal volumes of such packing made of laminated materials range from 20 cl up to 20 liters and more.

2. Description of the Prior Art

Plastic closures for sealing such combo packing are known in different embodiments. They comprise of a frame-type base element, to be welded on to the combo packing and a covering lid, which can swivel on that element, which covers the frame and hence seals the base element and is mostly provided with a guarantee, and the seal must be torn away for swiveling the covering lid for the first time.

A major disadvantage of these commercial closures is that the point, where the closure is placed on the combo packing, must be pre-treated, for which there are several variants. Often a hole is made there in the combo packing fitting in shape to the light opening of the closure, which is then sealed again later with a membrane liner. Only then the closure is placed on the punched hole on the packing, so that the membrane liner is removed when the covering lid of the closure is swiveled. To do this, for instance, a guide is extended in the opening of the base element. This is equipped on the top with a push button, which the user can press with his finger, after which the guide moves downward and thereby tears and presses down the membrane liner. However, this does not lead to a very clean outflow opening and the guide extends diagonally downward in the flow opening after being pressed down and thus obstructs the flow, unless it is pulled out again or cut away or tom away, which can only be done with difficulty. Moreover, pressing down the membrane liner with the finger is not always hygienic. The fingers can sometimes be dirty and unwanted bacteria can always reach the liquid unintentionally from the fingers.

In another variant the combo packing is weakened extremely at the point, where the closure is either stuck or welded on. For instance, the foil material is punched through except for the related membrane liner. This, however, requires extremely precise punching tools and punching machines. If a too deep punching is done, the membrane liner can be damaged or cut through and the combo packing can then no longer be sealed germ free. If a too low punching is done, then the consumers would have problems in opening the packing and can open it only by tearing away the closure of the combo packing with a lot of strength. Another pre-treatment makes use of the laser technology. Using a laser beam, the final piece of the combo packing to be punched out or to be removed is weakened, so that the sealing still stays intact by leaving the membrane liner undamaged. Even this pre-treatment is cumbersome and expensive. The laser beam must be tuned exactly to the laminated foil, so that it is neither too weak nor too strong. But since the laminated foils show certain tolerances in their strength because of their manufacturing, the setting for punching as well as for weakening with the help of a laser beam becomes an additional problem. This way or that way, expensive machines and devices are necessary. Moreover, the pre-treatments, no matter according to which method they are done, are to be done exactly at the correct point of the laminated foil, and accordingly, the plastic closures must be placed precisely over these pre-treated points. To do this, a lot of engineering effort is needed, which accordingly costs a lot.

Another disadvantage of the standard solutions is that after the first swiveling of the lid part, the closure must be opened through a separate manipulation, namely by pressing the membrane liner with the naked finger. However, this method of opening the membrane liner is unhygienic and in addition, the membrane liner is not always released completely and cleanly from the light area to the inside of the projecting margins. Rather, the membrane liner gets tom along the length of the opening of the closure somewhere in the middle range and is then not pressed downward in the inner space of the combo packing. This leads to a formation of brows on both the sides, which project downward in the inside of the combo packing and disturbs and restrict the free and clean outflow of the contents. If the combo packing is swiveled very strongly in the outflow position, then sufficient air may not get inside the combo packing, owing to the too little dimensioning of the opening. This leads to a bubbling i.e. to a discontinuous, squirt-like outflow of the contents, which makes it difficult to put an intended amount in a glass or in a jug.

No such closure is available, which provides such a big spout, through which a tablespoon or another similar measuring spoon can be inserted. The known carton packing for corn flakes and similar products are thus simple carton packing for a plastic bag kept in the packing. For opening, the carton packing must be tom away by hand, so that it can then be opened on the top by folding up the folded margins or else tearing the packing along a perforation. Only then one can grab the plastic bag inside, take it out a little, and then cut one corner of the bag with scissors or with a knife. The contents are then poured out by slightly tilting and shaking the carton packing, which, however, runs relatively uncontrolled. If such a packing is opened once, it cannot be sealed again cleanly. Here too, a closure with a pouring opening of adequate size would be desirable i.e. with at least 10 $cm^2$ to 20 $cm^2$ of pouring opening, which can be sealed again. For contents that are drawn out with a spoon, the closure must have such an opening i.e. possibly with a still bigger clearance, so that a tablespoon or another measuring spoon can be inserted inside the opening and the contents can be drawn out. Such a closure would then be suitable for combo packing and simple carton packing of all powder products, such as for milk powder, drink concentrates, rice, flour and food as well as non-food products having a similar consistency. Because the sealing is easier to achieve for granular products, essentially thinner laminates can be used than for packing for liquids, and the combo packing can also then be tom open relatively easily.

The known plastic closures also prove to be inadequate in a totally different aspect. Firstly, the outflow spout of the closures does not always have an advantageous embodiment, so that when the pouring is stopped, the liquid trickles down at the outer side of the spout and then flows down over the combo packing. This mess of the outflow is very annoying, because often the entire front side of the packing becomes dirty.

The lid part of the many standard closures is also not held reliably in the open position of the lid, so that the lid becomes loose in the region of the internal hinge between the lid and the lower part owing to material stresses and disturbs the out-flowing jet, unless one holds the lid consciously in the open position with one hand. In many cases, one hand is needed for holding the combo packing and for pouring, while the other hand holds a glass, in which the liquid is to be poured. In such cases, no hand is free for keeping the lid open and with the pouring hand, one can simultaneously keep the lid in its open position with great difficulty.

Moreover, the standard pouring out closures have less user-friendly sealing arrangements, which can ensure the first opening i.e. the first swiveling of the upper part of the closure. In some solutions, a guarantee tape must be ripped off, which must be held with two fingers. In practice, however, this proves to be quite difficult. For instance, if the user has applied hand lotion or cream to his hands, then it becomes difficult for him to rip-off the guarantee tape, as long as his fingers are greasy. Opening the closure with gloves is also just not possible. Finally, the resealing is also not satisfactory, because the closures themselves are not sealed sufficiently after swiveling the lid parts.

SUMMARY OF THE INVENTION

It is, therefore, an object of the present invention to provide a flap shutter for the combo- and carton packing, which, upon opening, enables an automatic and absolutely hygienic, clean, easy and complete opening of the laminated material or the carton over the clearance of the outflow and hence manages without a pre-treatment of the laminated material. Furthermore, the outflow closure, after opening, should enable a squirt-free, continuous flow of an adequately thick flow of the liquid. The closure should also be functional and can be manufactured in such large dimensions for the combo- or carton packing for granular or powdery products, so that in its open position a tablespoon or any other measuring spoon can be inserted inside for the purpose of taking out a spoonful of the contents. Secondly, in a special embodiment the outflow closure should also provide a secure tamperproof seal, whereby one must be able to open the closure easily the first time too. Further, the closure must also ensure that the lid part is held reliably by itself in its open and closed position. Finally, it must ensure a pouring without a trickling of the liquid jet at the outside of the pouring spout and enable a well-sealed closing after use.

The main task itself is solved by a flap shutter for combo and carton packing for automatically opening the packing by opening the closure lid, comprising of a frame-type base element, which, with its flat base is to be welded or stuck on to carton packing and a peripheral projection, projecting upward for forming an outflow support opening inside, as well as a lid closing the pouring support, placed on it swiveling and formed from it, for opening and closing on the base element, whereby this flap shutter is characterized by the fact that a guide, placed swiveling on the base element, extends over the inner side of the projection, and that forced-closing means are available between the guide and the lid, with the help of which the guide can be swiveled downward in a direction contrary to that of the lid and which then cuts or rips through the underlying packing material.

BRIEF DESCRIPTION OF THE DRAWING FIGURES

The drawings show several embodiments of such a flap shutter in different views. These flap shutters are then subsequently described and their function is explained.

Figure 2:
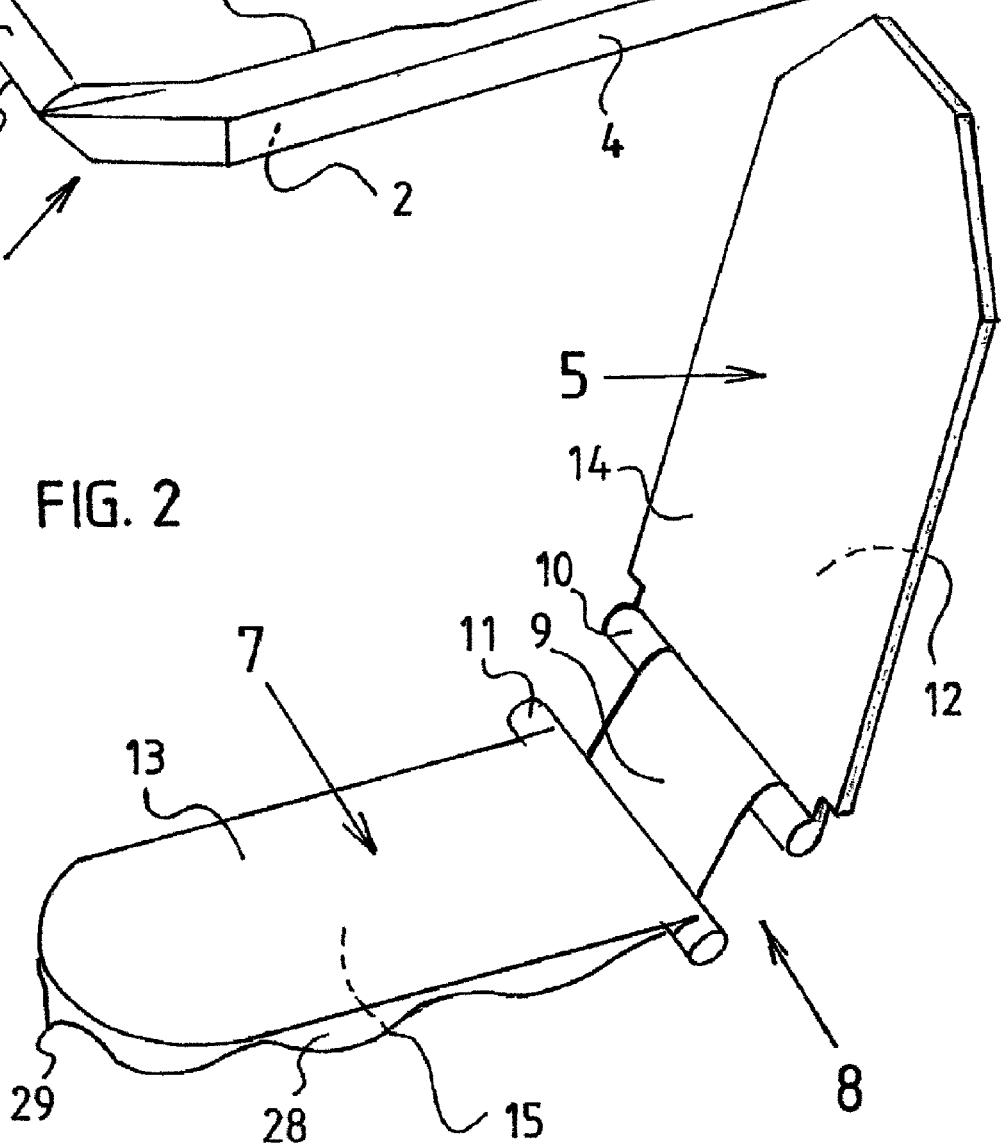
Figure 3:
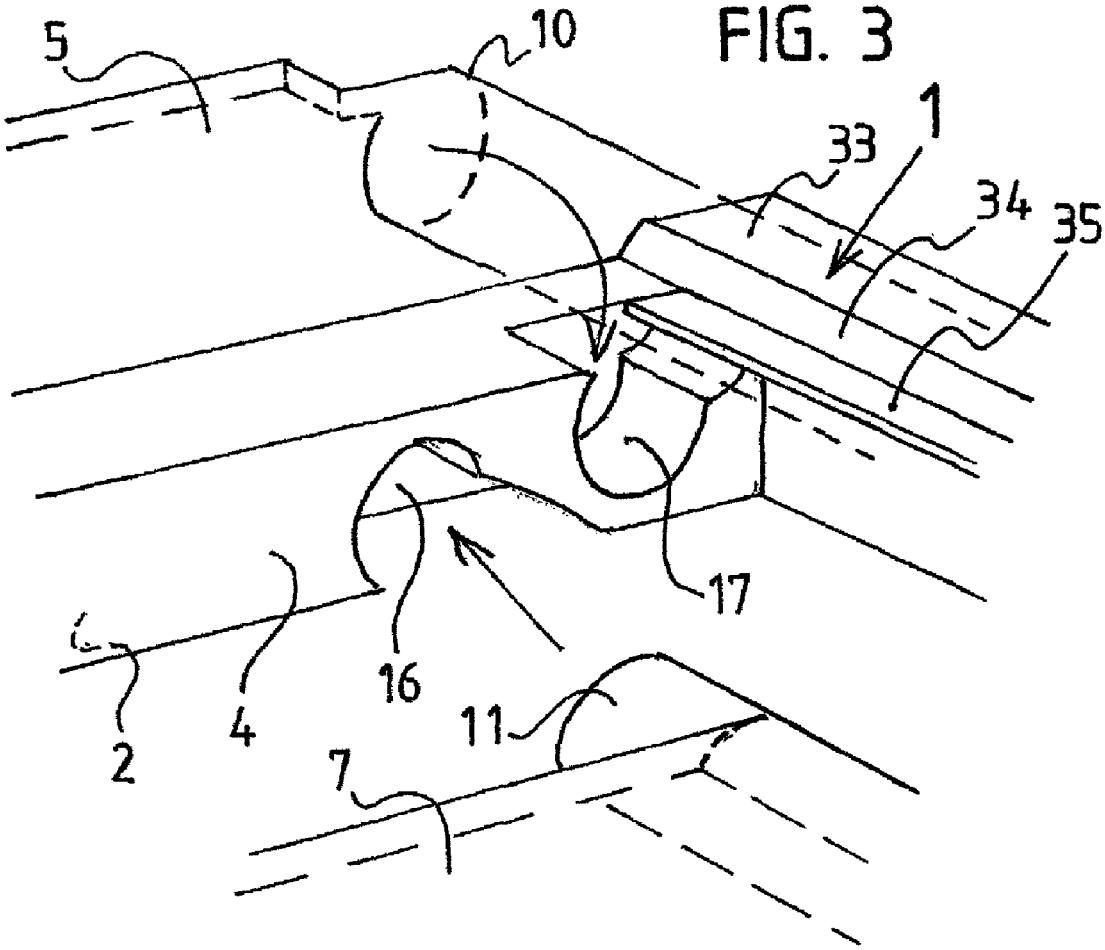
Figure 4:
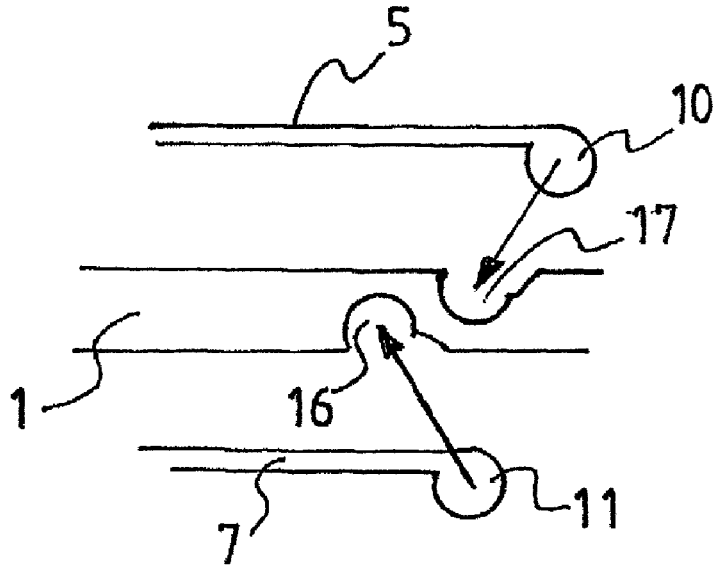
Figure 5:
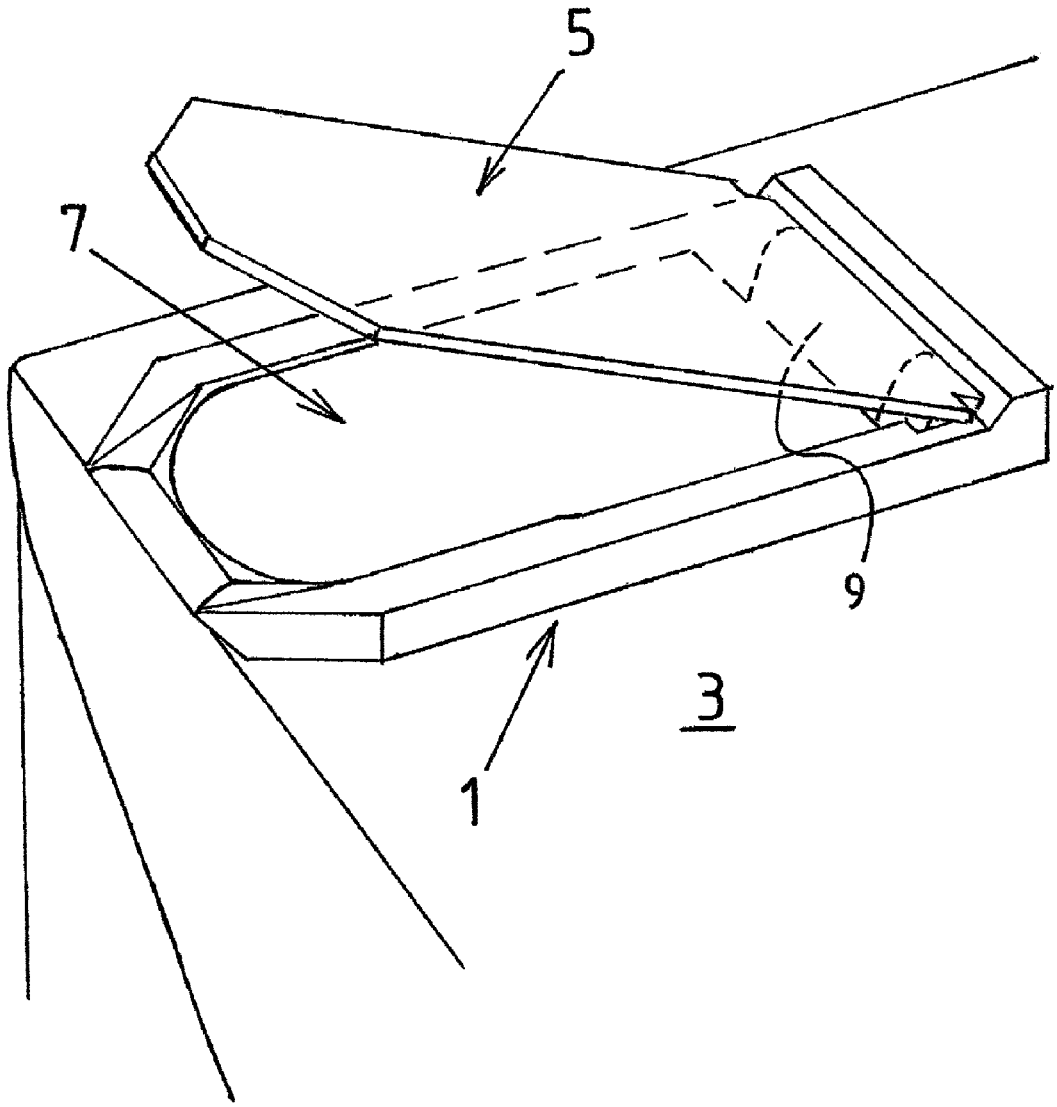
Figure 6:
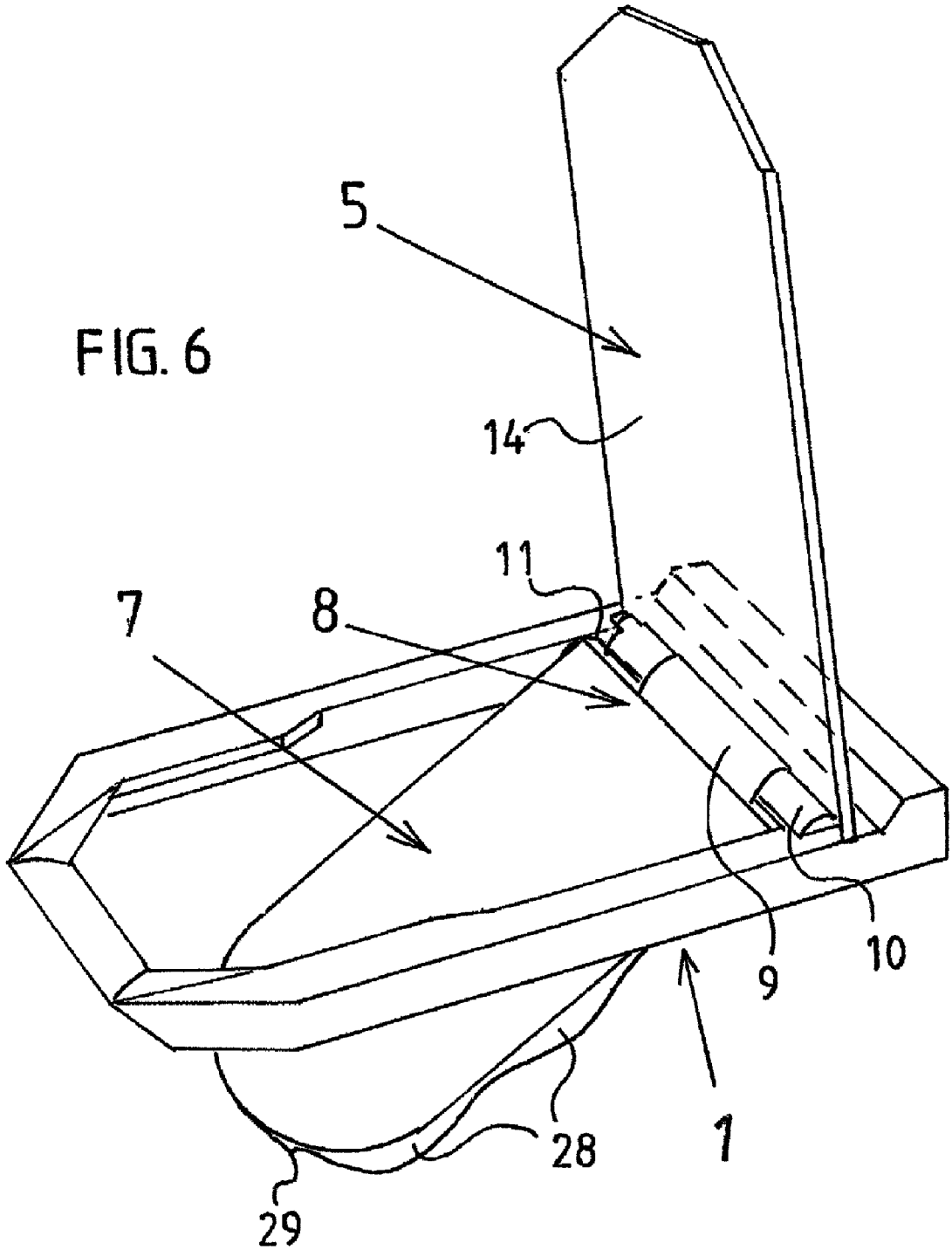
Figure 7:
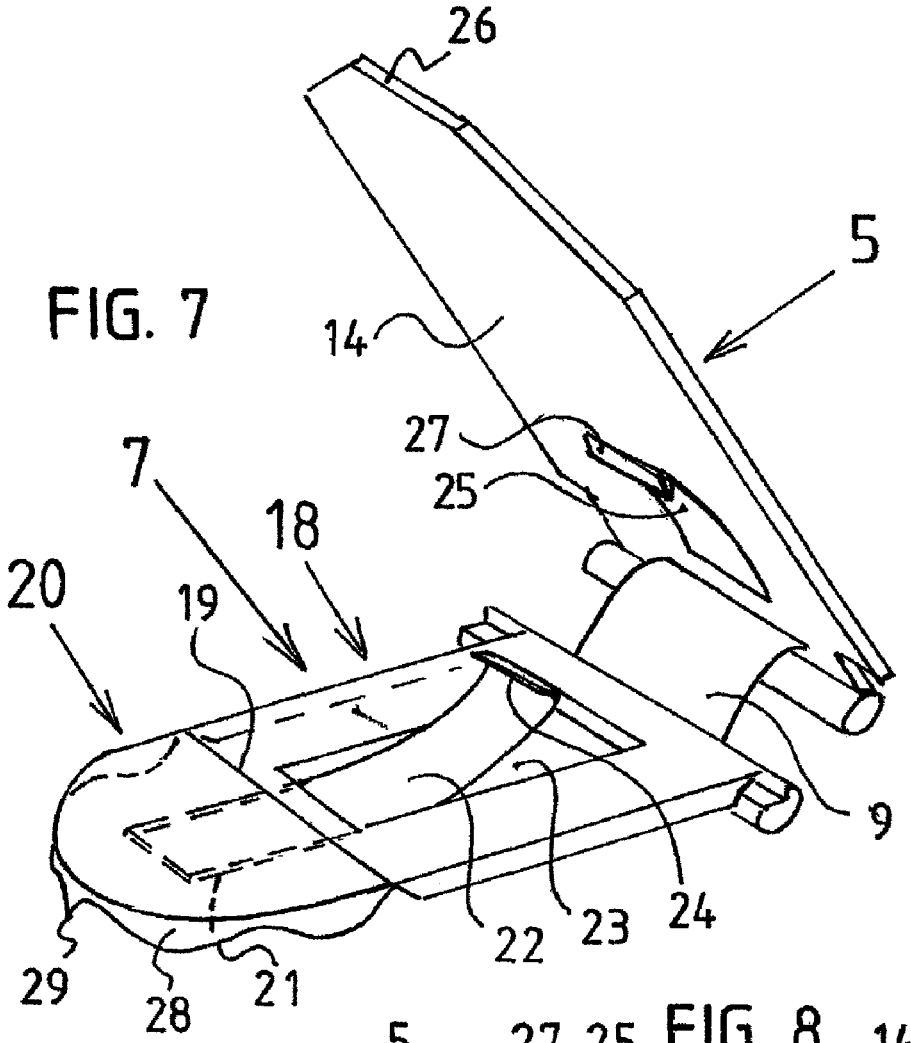
Figure 8:
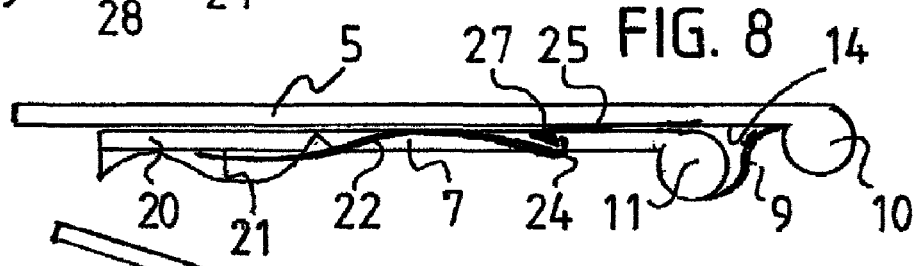
Figure 9:
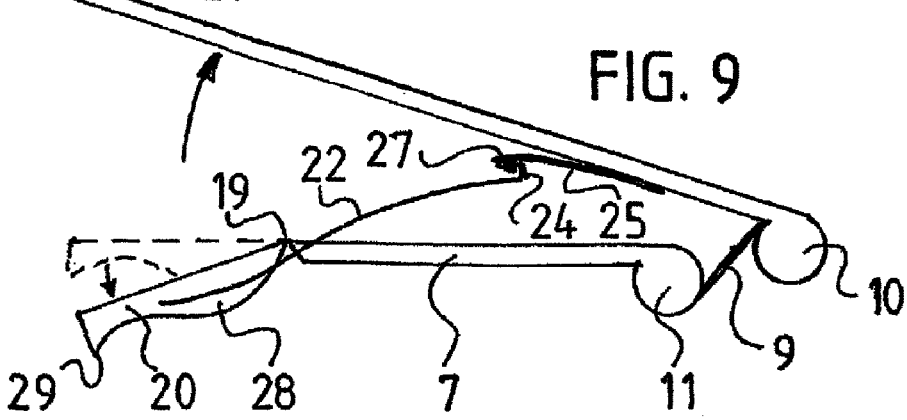
Figure 10:
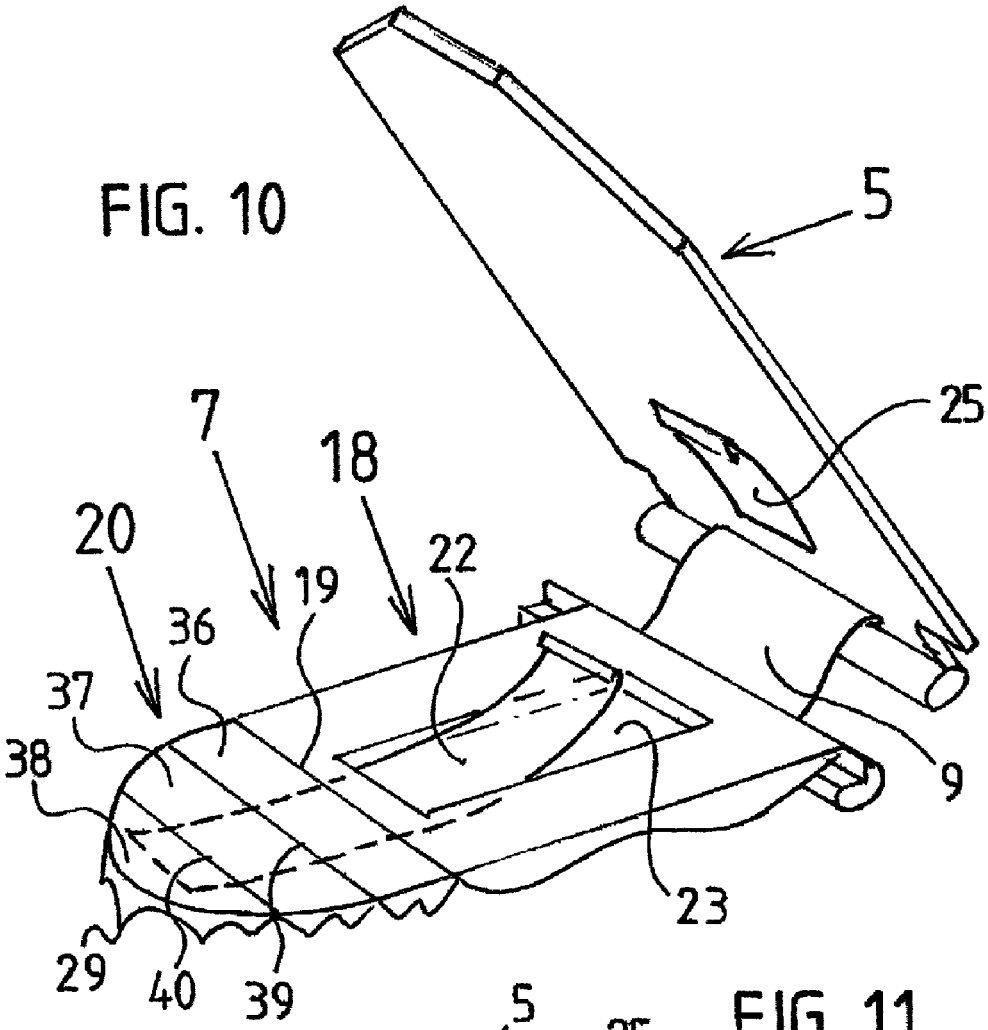
Figure 11:
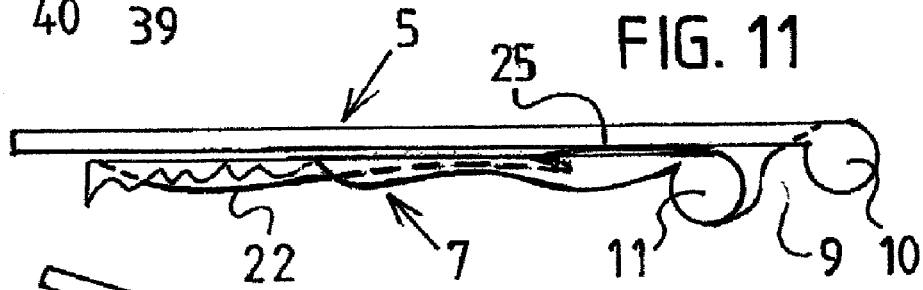
Figure 12:
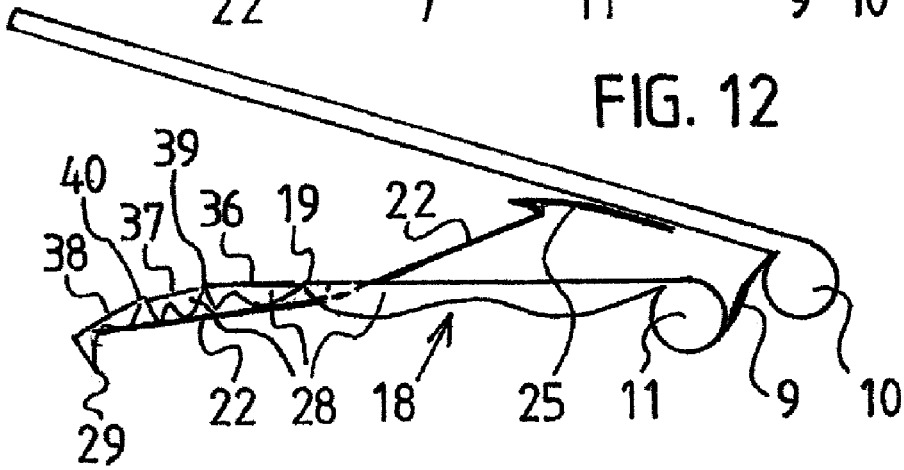
Figure 13:
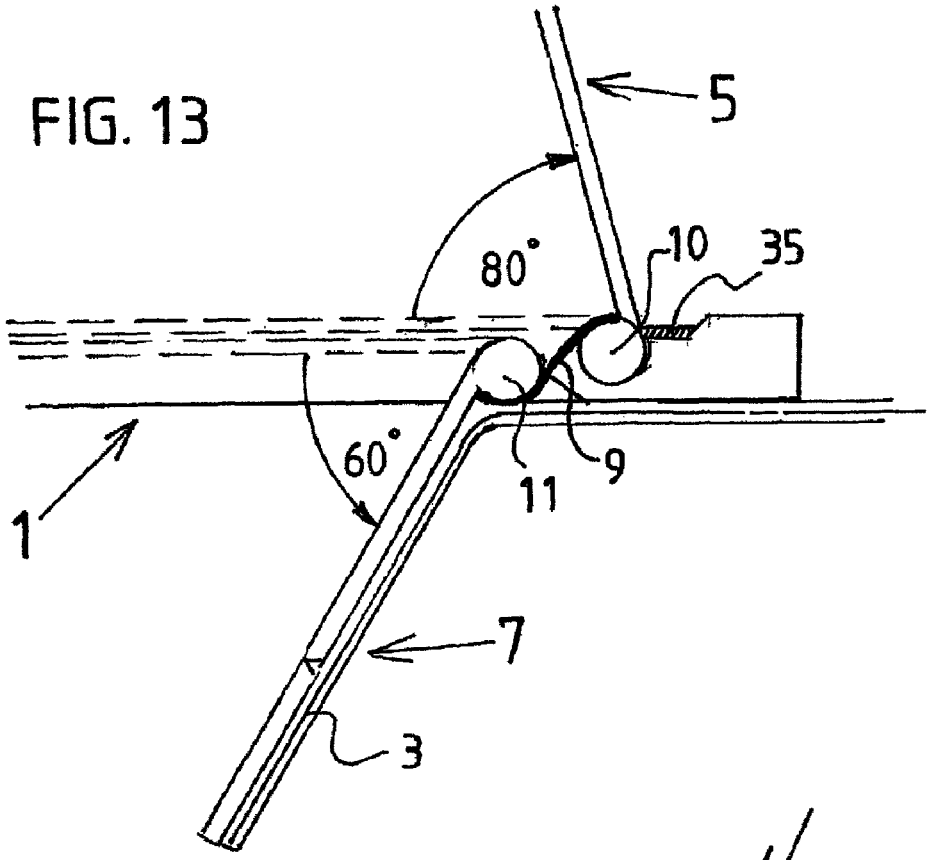
Figure 14:
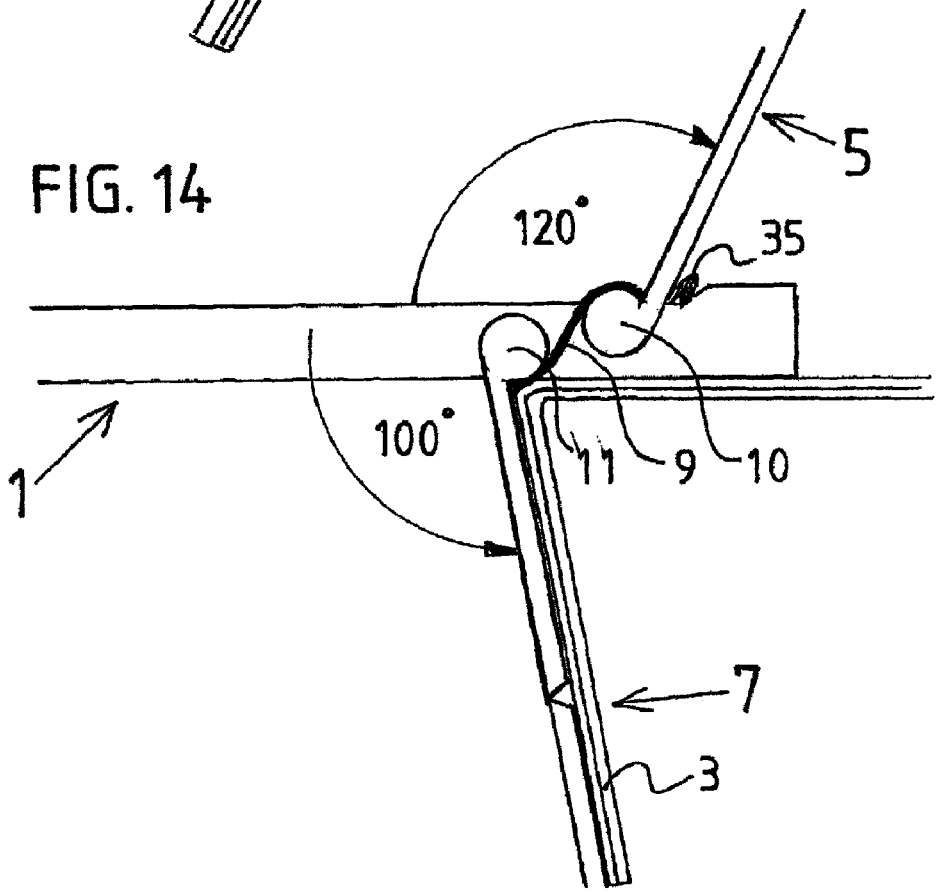
Figure 15:
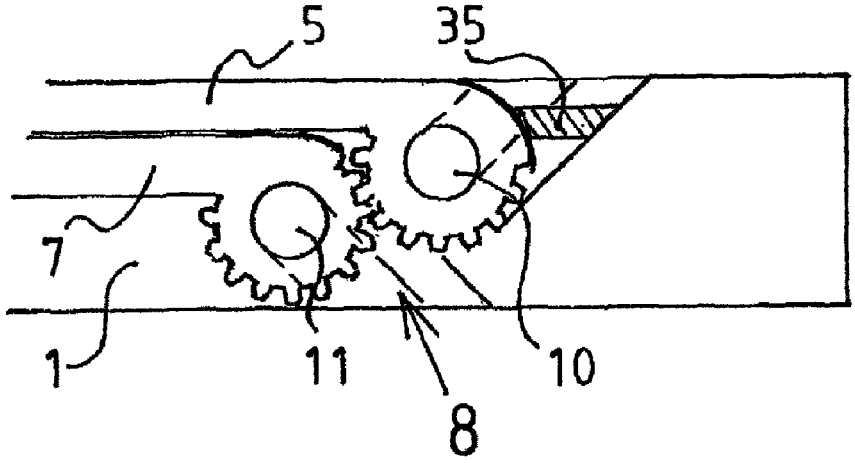
Figure 16:
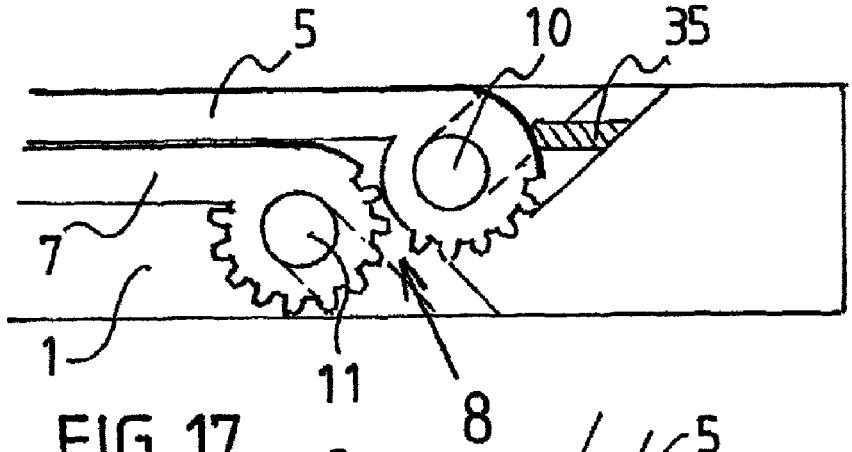
Figure 17:
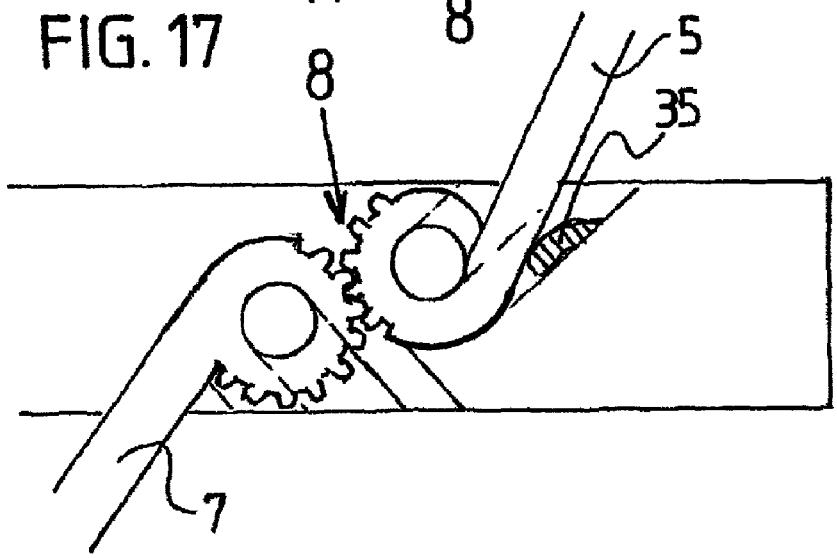
Figure 18:
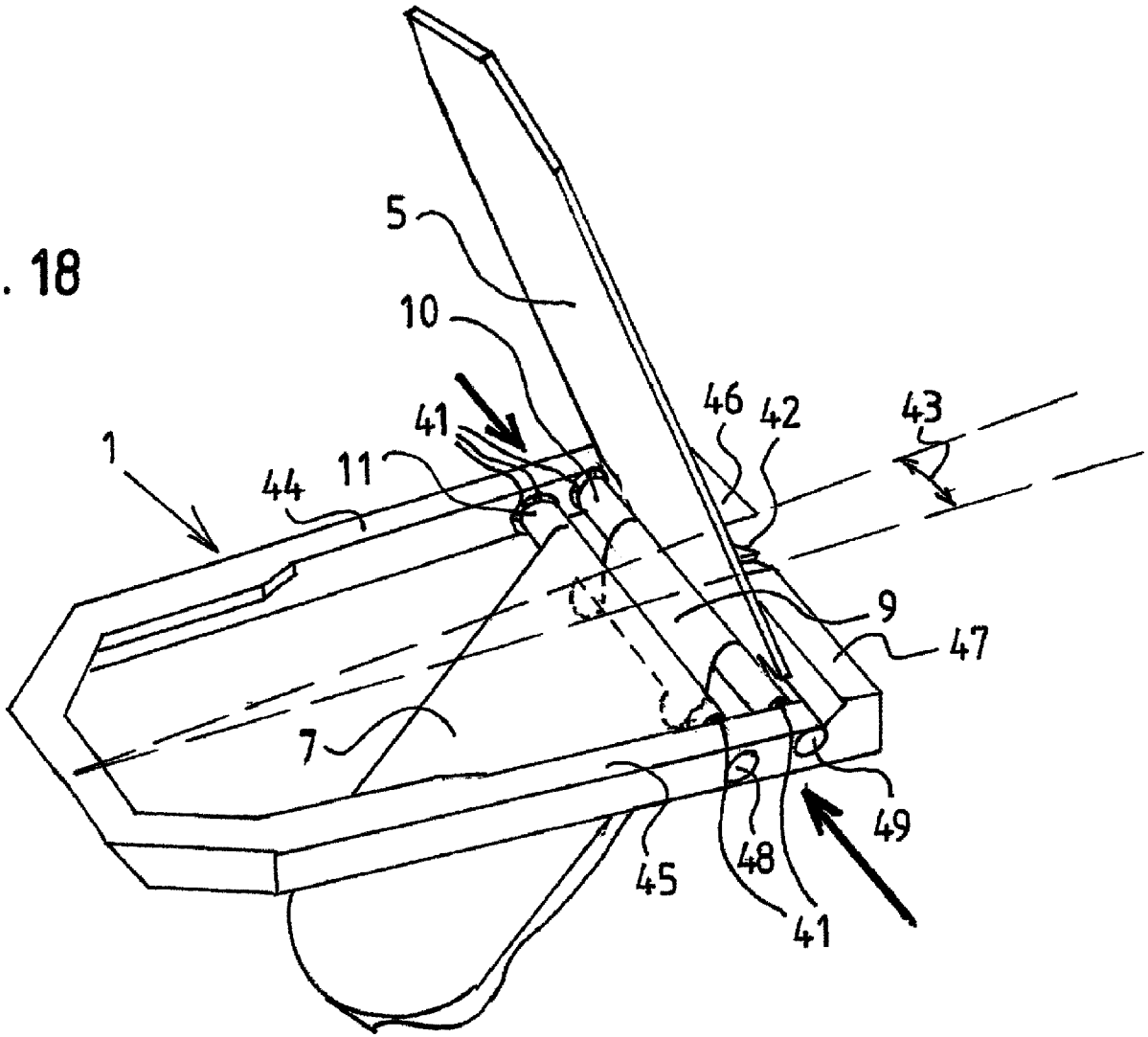

The drawings show the following:

FIG. 1: The base element of a flap shutter;

FIG. 2: The guide and the lid for the flap shutter as per FIG. 1;

FIG. 3: The section A from FIG. 1, namely the bearing bushes for the rotating position of the guide and of the lid on the base element;

FIG. 4: Setting of the guide and of the lid in the base element, seen from the side, schematic representation;

FIG. 5: The assembled flap shutter made of base element, guide and lid, welded on to a combo packing;

FIG. 6: The flap shutter in a partly opened state;

FIG. 7: The guide and the lid of a flap shutter for the two-stage ripping-off and swiveling down a piece of packing;

FIG. 8: The guide and the lid from FIG. 7 in a schematic view seen from the side, in the initial state with the closed lid;

FIG. 9: The lid and the guide from FIG. 7 in a schematic view seen from the side, after swiveling the lid from the base element by about 20° for the first stage of ripping-off;

FIG. 10: The guide and the lid for a flap shutter in a variant for the two-stage ripping-off and swiveling down of a packing piece;

FIG. 11: The lid and the guide from FIG. 10 in a schematic view seen from the side, in the initial state with the closed lid;

FIG. 12: The lid and the guide from FIG. 10 in a schematic view seen from the side, after swiveling the lid from the base element by about 20° for the first stage of ripping-off;

FIG. 13: The lid and the guide in the second stage of opening in a schematic view seen from the side, after swiveling the lid from the base element by about 80° during the second stage of the ripping-off of the packing by the guide;

FIG. 14: The lid and the guide in a schematic view seen from the side, after the complete swiveling of the lid from the base element by around 120° and after completion of the second stage of ripping-off of the packing by the guide;

FIG. 15: An alternative embodiment of a flap shutter with swivel shafts, which form gear rod over an axial section;

FIG. 16: An alternative embodiment of a flap shutter with swivel shafts, which form gear rod over an axial section and which enable a two-stage ripping-off of the packing and swiveling down of the guide, here in the closed state;

FIG. 17: The embodiment of the flap shutter as per FIG. 16 in the open state;

FIG. 18: An embodiment of the flap shutter, which permits its one-piece squirt.

DETAILED DESCRIPTION OF THE DRAWING FIGURES AND PREFERRED EMBODIMENTS

FIG. 1 shows at first just the base element 1 for a flap shutter as the first of two plastic squirt parts. This base element 1 builds here a somewhat rectangular frame, which is welded or stuck on to a combo or carton packing with its bottom side 2. The base element 1 forms a projection 4 projecting upward, which in principle forms an outflow or a pouring support. In the front region, this frame is shaped in an pouring spout 31 with sharp tear-off edges 32. The inner side of the frame remains free and forms the dear passage cross-section 6 of the outflow support formed by the frame. In the front region of the base element 1 this shows inner margins 30, directed towards inside and projecting inside the clear width, which act as stoppers, as will be explained later. In the rear region of the base element 1 are the two bearing bushes 16, 17 on each side at the inner side of the projection 4. These are meant for accepting the bolts, which will be explained later. The bearing bushes are u-shaped, i.e. they are open on one side. The front bearing bushes 16 are thereby drawn out from the bottom side 2 of the base element 1 at an angle of approx. $45^C$ vis-à-vis the bottom side of the base element 1 diagonally upward and directed on the front. Connecting just behind these bearing bushes 16 are the bearing bushes 17, which are drawn out at the base element 1 from the top at an angle of approx. 45° vis-à-vis the top side of the base element 1, however, diagonally downwards and directed on the front. Behind the bearing bushes 16, 17 stretches the rear closing of the base element 1, which forms here an top 33, whose frontal angular face 34 aligns with the rear inclined and plane surface of the clearance 17. A sealing lip 35 can be formed between the top 33 and the underlying part of the base element 1, which projects above forward over the inclined surface 34. This sealing lip can be die extruded from the same material i.e. connected as one piece with the base element 1, but can also be die extruded later with a second extruded element.

FIG. 2 shows as the second injection-molded part of the flap shutter a guide 7 and a lid 5, which forms a swiveling flap. On the front the guide 7 shows a semi-circular end and at the margin of the guide a sharp blade 28, projecting downward, is formed, which forms a downward projecting piercing tip 29 at the tip of the guide. The sharp blade 28 is formed by a margin of the guide projecting downward, which can be equipped with ribs on the inner side vis-à-vis the bottom side 15 of the guide plate for strengthening. At its rear side the guide 7 merges in a swivel shaft 11, whose diameter is about three times the thickness of the guide plate. The top side 13 of the guide 7 thereby runs tangentially in the swivel shaft 11. Accordingly, the swivel shaft 11 projects beyond the guide plate on its bottom side to about two-thirds of its diameter. Moreover, the swivel shaft 11 is dimensioned somewhat longer than the width of the guide 7, so that it projects a little beyond it on both the sides. The projecting stubs build the bolts, which can be inserted from below in the already described bearing bushes 16 at the base element 1. The margin of the guide 7, projecting downward, as described above, which forms a blade 28, can be designed only as high as the measure of the diameter of the swivel shaft 11. The lid 5 is formed here somewhat behind and above the guide 7. On its rear side, it shows a swivel shaft 10, and as in the case of the guide 7, the top side 12 of the lid 5 runs tangentially in the swivel shaft 10. The thickness or the strength of the lid plate similarly measures about ⅓ of the diameter of the swivel shaft 10, which has the same diameter as the swivel shaft 11 of the guide 7. The swivel shafts 10, 11 can be designed hollow on the bottom for spraying reasons, for instance, when they comprise of a series of evenly spaced diameter discs, which are connected to one another by a thin outer wall of the shaft. Between the guide 7 and the lid 5 means for power closing 8 are available, which see to it that the guide 7 is swiveled forcefully downward in a swiveling direction opposite to that of the lid 5 by cutting or ripping an underlying piece of the packing. These means for power closing 8 are realized here by a retracting band 9. The guide 7 is connected to the lid 5 by means of a retracting band 9, whereby this is designed as follows: The retracting band 9 is fixed with one of its ends at the bottom side of the guide 7 or formed directly at this. It then roots along the edge, which forms the swivel shaft 11 along the length of the bottom side of the guide 7 with the same and from there the retracting band 9 is led around the swivel shaft 11 downward and then upward and formed at the bottom side of the lid 5 with the swivel shaft 10, for instance along the length of the corner between the swivel shaft 10 and the bottom side of the lid. In this case the guide 7, retracting band 9 and lid 5 form a one-piece extruded part. As a variant the retracting band 9 can also be led through a slit in the guide plate, which stretches along the length of the corner between the swivel shaft 11 and the bottom side of the guide, formed at the bottom side of the guide. The slit can show a cross-section tapering downward, and the end of the retracting band is then provided with a collar, cone-shaped in the cross-section. It can be plugged by the slit on the downside. Hereafter, a strip with a cone-shaped profile is clipped from the top in the slit near the collar, so that the retracting band is held firmly in the slit. The retracting band comes out at the lower end of the guide and is then led around the swivel shaft 11 and ends at the bottom side of 14 of the lid 5. There it is formed in the corner and along the length of the same, which is formed from the bottom side 14 of the lid 5 with the swivel shaft 10 of the lid 5. If now the bolts of the swivel shaft 11 of the guide 7 fit in the bearing bushes 16 at the base element 1 and the bolts of the swivel shaft 10 of the lid 5 fit in the bearing bushes 17, then one can see from FIG. 2 that upon a swiveling of the lid 5, which has already been swiveled high a bit, owing to the geometric arrangement of the lid 5 relative to the retracting band 9 and to the guide 7, the retracting band 9 is stretched and pulled around the swivel shaft 10. The tension of the retracting band 9, which is wound at the guide 7 around its swivel shaft 11, creates a torque at this swivel shaft 11, which then causes the formed guide 7 to swivel from the position shown. In the same measures as the lid 5 is swiveled up and down, the guide 7 is also swiveled up and down. If the guide 7 is swiveled down forcefully, then the piercing tip 29 at the blade 28 first pierces the packing material below it, and thereafter the blade 28 cuts further from this hole, so that upon swiveling back the guide 7 the underlying piece of the packing material is cut out from the packing and is folded downward, as will be described in more detail. The swiveling force of the guide 7 for cutting out and folding down the packing material lying below the guide 7 can thereby be quite different, because the tensile strength of a thin retracting band 9 made of plastic is very high and the reaction forces are absorbed from the bolts, which can absorb very high shearing forces.

FIG. 3 shows a detail at the base element 1, namely the bearing bushes 16, 17 for the rotary position of the guide 7 and of the lid 5 in a magnified view. The rear corner of the base element 1 from FIG. 1 is shown here, namely the section A in FIG. 1. One can easily see the U-shaped bearing bushes 16, 17. The front bearing bushes 16 serves for accepting the bolts of the swivel shaft 11 at the guide 7. Here, only one bearing bushes 16 is visible, while the other bearing bushe, lying as a mirror-image on the opposite side, is not visible. These bearing bushes 16 are drawn out from the bottom side 2 of the base element 1, at an angle of around 45° vis-à-vis the bottom side 2 of the base element 1 diagonally upward and directed on the front. On the rear side, at the rear side of the bearing bushes 16 arranged in the direction of the rear side of the base element 1, which forms the longer U-arm, the rounding of the U is continued a piece further, so that it encompasses a round blot, to be set in the bearing bushes 16, by more than 180°. The bolt is set by inserting it in the bearing bushes 16 from below with a slight expansion of the same and slides them in the quasi-hollow cylindrical bearing and is held in the same. However, the rounding of the U can also merge tangentially in the rear side of the bearing bushes 16, so that a round bolt is fitted effectively by 180°. However, when the base element 1 is welded on to a combo packing with its bottom side 2 or else is stuck on to it, then the bolts of the swivel shaft 11 are led from the combo packing in the bearing bushes 16 and are thus held in their position. In operation i.e. when the closure is activated, the forces act only in the direction of the semi-circle shaped wall of the bearing bushes, but not in the opposite direction, as is explained below. Just behind the bearing bushes, the bearing bushes 17 for the swivel shafts 10 of the lid 5 are connected, which are drawn out of the base element 1 on the top, at an angle of approx. 45° vis-à-vis the top side of the base element 1 diagonally downward and directed on the front. In the same way, these bearing bushes can be formed at their longer U-arm in such a way that they encompass a set in bolt 10 by more than 180°. The bolts 10 are then clamped in this by a slight expansion of the U-arm of the bearing bushes 17. This is advantageous, because then the bolts 10 are held firmly in their position. However, this step is not absolutely necessary, because in the operation i.e. while opening the closure, the forces act only in the direction against the rounding of the U-shaped bearing bushes 17, as will become clear again. The rear, longer wall of the U-arm can thus also be designed plane. Behind the bearing bushes 16, 17 the rear closure of the base element 1 stretches, which forms here an top 33, whose front angular face 34 merges with the rear, plane surface of the clearance 17. Between the attachment and the underlying piece of the base element 1 a sealing lip 35 can be formed, which extends above the inclined surface 34 and lies very close at the swivel shaft 10 of the attached lid 5. This sealing lip can be extruded from the same material 35 or can also be extruded from a second, resilient extruded material.

FIG. 4 shows in a schematic side view, how the lid 5 and the guide 7 are set in the base element 1. The bolts of the swivel shaft 10 of the lid 5 are held in the bearing bushes 17 and the bolts of the swivel shaft 11 are held at the bearing bushes 16 at the guide 7. When the guide 7 and the lid 5 are connected one-piece via the retracting band 9, then at first the guide is led through the base element 1 twisted from the top with the tip forward against the base element 1 by 90°, thereafter rotated back by 90° and still in vertical position to the base element, the bolt stubs of its swivel shaft 11 on both the sides are set in the corresponding bearing bushes 16 at the base element 1. Because the guide 7 extends downward, the retracting band 9 is not stretched if the lid is swiveled back and permits that the lid 5 handing at this retracting band 9 is afterwards pushed back in its correct position and the bolt stubs of its swivel shaft 10 can be set in the corresponding bearing bushes 17 at the base element 1.

FIG. 5 shows the flap shutter in the assembled state, with base element 1, guide 7 and lid 5, mounted on a combo packing 3. When the lid 5 is completely closed i.e. when the flap formed by it is completely swiveled down on the base element 1, then the retracting band 9 is not stretched, but instead winds loosely around the swivel shafts at the guide 7 and the lid 5. In the state shown here, the lid 5 is already elevated or swiveled up a little, and in this position the retracting band 9 is tight. Upon a further swiveling of the lid 5 the tensile force acting on the retracting band 9 produces a torque on the guide 7, so that this is swiveled down in a direction opposite to the swivel direction of the lid 5 at the base element 1, as is described below in more detail.

In FIG. 6 the flap shutter described is shown upon swiveling the lid 5 or the flap formed by it. When the lid 5, as shown, is swiveled from the base element 1, then the retracting band 9 fixed or formed at its bottom side 14 exerts a force on the retracting band 9 owing to the geometric arrangement of the swivel shaft 10 at the lid 5. As described, the retracting band 9 is wound around the swivel shaft 11 at the rear side of the guide 7 and fixed or formed at its lower end. The tensile force of the retracting band 9 produced by swiveling the lid 5 produces a torque at the swivel shaft 11, around which it is wound, which is transferred to the guide 7 formed at the swivel shaft 11. Consequently, the guide 7 is swiveled down at the swivel shaft 11. While the lid 5 is swiveled in the clockwise direction in the figure, the guide 7 swivels in the opposite direction i.e. downward in the counter-clockwise direction in FIG. 6. When the flap shutter is welded or stuck on to a combo or a carton packing, then the piercing tip 29 pierces the packing right at the front at the tip of the guide and thereafter the blade 28 cuts out, along the length of the guide margin, the packing material lying below the guide 7 from the packing material and thereafter the guide 7 swiveling down pushes down the cut out piece of the packing material. As long as the lid 5 of the closure is swiveled up, the cut-out piece of the packing material remains pushed down and hence the cleared cross-section of the closure is made free for reliably pouring out the contents of the packing. Since the closure can also be designed so large that a tablespoon or any other measuring spoon can be inserted in it, it is also possible to remove the contents of the packing by means of a measuring spoon. When the guide 7 is swiveled back, the reaction forces act on the base element 1 and pull it away from the combo packing. Therefore, if necessary, the base element can be made up of a broader frame, so that a larger surface for sticking or for welding is made available at its lower surface, and in this way the acting reaction forces can be absorbed more reliably, without ripping away the frame from the packing.

FIG. 7 shows an advanced variant of the flap shutter for a two-stage ripping off and swiveling down of a packing piece. In contrast to the closure described earlier, the guide 7 here shows in the front part 20, which is connected with the rear part 18 only via a internal hinge 19, which runs transverse across the guide 7. This front part 20 can thus be swiveled down separately vis-à-vis the rear part 18 of the guide 7. The front part 20 is provided with a blade 28 along the length of its margin, which extends downward from the front part 20 and at the tip of the guide is formed a piercing tip 29. The blade 28 can be strutted vis-à-vis the bottom side of the guide 7 by means of radial ribs, so that it has a higher stability. In the rear part 18 the guide 7 has a recess 23. At the bottom side 21 of the swiveling front part 20 of the guide 7, a retracting band 22 is formed, which leads to the rear from there via the internal hinge 19 and then through the recess 23 upward to the top side of the guide 7. This retracting band consists of the same material as the complete closure. Owing to its thinness, it can be bent and owing to its material quality, it has a high capacity to carry tensile stress. At its end, this retracting band 22 shows a barbed hook 24 curved upward, which stretches over the entire width of the retracting band 22. The counter-piece of this retracting band 22 is present at the bottom side 14 of the lid 5 as a retracting band 25, with the same bending and strength properties. This is formed, not far from the swivel shaft 10 of the lid 5, at its bottom side 14 and stretches from their in the direction of the front end 26 of the lid 5 and is slightly curved downward. At its front end, it forms a barbed hook 27 effective over the entire width. The geometric arrangement of the guide 7 and the lid 5 at the base element on one hand and the geometric arrangement of the retracting bands 22, 25 as well as the internal hinge 19 is now selected in such a way that in case of the swivel position of the lid 5, shown here, the ends of the retracting bands 22, 25, facing each other, cannot touch. On the other hand, if the lid 5 is swiveled down on the guide 7, then the barbed hooks 24, 27 of the two flexible retracting bands 22, 25 fit in one another and thereby produce a connection resistant to tensile force. In this embodiment of the flap shutter, the retracting band 9 is designed in its length between the guide 7 and the lid 5 in such a way that it remains flaccid in the first phase of swiveling the lid 5 and produces a tensile force only after a swivel position of the lid 5 vis-à-vis the guide 7 by about 30°-45° and only then does the swiveling down of the complete guide 7 starts. In a first phase of swiveling the lid 5, thus rather the retracting bands 22, 25 are acting with a very high tensile force owing to the acting leverage. The lid 5 itself thereby acts with its entire length as the lever and the distance from its swivel axis to the forming point of the retracting band 25 acts as the load lever. As a result of this, the tensile force acting at the retracting band 25 is already multiplied with a factor of 4 to 6 vis-à-vis the swivel force applied at the lid 5. This tensile force then acts on the retracting band 22, which causes the front part 20 of the guide 7 to swivel down. The reaction force on this swiveling down is expressed in an attempt of the rear part 18 of the guide 7 to swivel forward. However, this is refused to the rear part 18, because for this the base element 1 shows projections 30 on the side, projecting inward, which are visible in FIG. 1, and at which both the margins at the top side of the rear part 18 of the guide 7 stop. Accordingly, a large swivel force acts on the front part 20 of the guide. This front part 20 is thus also able to pierce and cut a strong packing material i.e. to make a semi-circular cut along the length of the blade 28 in the packing material. Till this cut is made, the lid must be swiveled up by about 30°-45°, and then the merging of both the retracting bands 22, 25 tears off for geometrical reasons and both the retracting bands 22, 25 separate from each other. In order that the merging separates, the barbed hooks 24, 27 are shaped accordingly, so that they hold sure for a slightly elevated swivel position of the lid 5, while they slide past each other after exceeding a certain swivel position, because the angle, with which the retracting band 25 and its barbed hook 27 stands vis-à-vis the barbed hook 24 at the retracting band 22, gets enlarged with increasing swiveling of the lid 5. Therefore, it is a question of the embodiment of the barbed hooks 24, 27, so that they slide past each other when the desired swivel position of the lid 5 is reached. As soon as the sliding past is done, the guide 7 is swiveled downward as a whole through the further swiveling of the lid 5 over the retracting band 9, because this is taut now that the swivel position of the lid has been reached.

To illustrate this movement of the flap shutter with its two-stage ripping-off of the packing material, FIG. 8 shows first the lid 5 and the guide of the closure in a schematic view as seen from the side, in the initial state with the lid 5 closed. One can see how the retracting band 22 with its barbed hook 24 is formed at the bottom side of the front part 20 of the guide 7 and is led upward through the guide 7. The lid 5 is swiveled down on the guide 7 and the barbed hook 27 at the retracting band 25, which is formed at its bottom side 14, lies beyond the barbed hook 24. The retracting band 9 between both the swivel shafts 11, 10 on the other hand lies loose, i.e. with a little play between its fixing points at the ends.

FIG. 9 now shows the lid 5 slightly swiveled away from the base element, that is also swiveled away from the guide 7, because the retracting band 9 remained in this swivel position and did not exert any force. For this reason, the guide 7 is not yet swiveled down as a whole, rather, the retracting band 22 is pulled at the bottom side of the lid 5 through the force of the retracting band 25 and because the guide 7 cannot deviate upward owing to the projecting margin 30 at the base element 1, only its front part 20 is swiveled down at the axis of the internal hinge 19, as marked by the arrow. The piercing tip 29 at the blade 28 at the front part, thus pierces the laminate running below the guide 7 and when the front part 20 of the guide 7 is swiveled down further, a cut is made in the packing material along the length of the blade 28. As soon as this position is reached, the barbed hooks 24, 27 of the retracting bands 22, 25 slide past each other. At the same time, the retracting band 9 is tightened between the swivel shaft 11 of the guide 7 and the swivel shaft 10 of the lid 5. If the lid 5 is now swiveled further, then only the retracting band 9 is effective and the guide 7 is swiveled down as a whole. The reaction forces in the swiveling of the lid 5 act on its swivel shaft 10, but succeed only in pressing the swivel shaft 10 against its bearing bushes 16 in the base element 1 and cannot spring out of it. The first phase of the opening, in which only the front part 20 of the guide is swiveled down, is important for piercing and tearing away the packing material, which is especially critical. Once done, the packing material can then be tom away relatively easily.

FIG. 10 shows an alternative embodiment of the guide 7 for a two-stage tearing of the packing. Here, the front part 20 of the guide 7, which can be swiveled vis-à-vis the rear part 18 of the guide 7 around the internal hinge 19, is itself divided in three sections 36, 37, 38, which are connected with one another via the internal hinges 39, 40. The retracting band 22 is formed at the front-most section 38 and goes from there below the entire front region 20 of the guide 7 and thereafter through the recess 23 to the top side of the guide 7. The retracting band 22 acts together with the retracting band 25 in the way already described at the bottom side of the lid 5.

FIG. 11 shows this alternative embodiment of the guide 7 together with the lid 5 in a schematic view as seen from the side. Here the starting position is shown, in which the lid 5 lies on the guide 7 with the closure still closed and the retracting band 9 between the swivel shafts 10 and 11 is not yet stretched. If the lid 5 is now lifted, then its retracting band 25 pulls it back owing to the hooking of its barbed hook with that of the retracting band 22. The retracting band 22 thus pulls back with its end the front-most section 38 at the guide tip. But because the section cannot yet be pulled back, it deviates downward by swiveling around the internal hinge 40, as shown in FIG. 12. Owing to the shortness of the section 38, which acts as the arm, good leverages result, whereby the piercing tip 29 at the section 38 can exert a very high piercing force on the packing below it, so that this material gets pierced. Once the piercing is done, the regions 38, 37 and 36 swivel by a further pull at the retracting band 22 and by a further swiveling of the lid 5 downward one by one, whereby the blades 28 formed on them further tear apart or cut the packing material starting from the point of piercing. The retracting band 22 running below the regions 36, 37 and 38 and the tension in it ensures that at first only the foremost region 38 is swiveled down, thereafter the region 37 and finally the region 36. Only when all these regions 36-38 have been swiveled down and the guide 7 has thus cut out a U-shaped flap from the packing material, the hooking of the two retracting bands 22, 25 is released as a result of the geometric conditions. From now on, the retracting band 9 acts on the rear part 18 of the guide 7 and swivels it along the length of the guide margins thereby cutting the packing and the blade 28 formed on it further down. The flap-shaped piece of the packing cut out in this way is swiveled down by the guide 7 and thus makes way for the outflow of the contents.

FIG. 13 shows the situation after the further swiveling of the lid 5, when this is swiveled by about 80°. The guide 7, which has been displaced by about 20° vis-à-vis the base element 1 owing to the now tight retracting band 9 starting from a swivel position of the lid 5 and thereafter is swiveled exactly by the same measure as the lid 5, has thus, for a swiveling of the lid by 5 by 80° experienced a downward swiveling by 80° minus 20°, i.e. a swiveling of 60°, as shown here. In case of this swiveling, the guide 7 has further tom away the underlying combo packing 3 along the length of the guide margins and has pushed it further down. The angle measure specified is only an example. The swiveling angle of the lid, after which the retracting band 9 becomes tight, can be selected. It depends on the selected geometry of the components of the closure, which can be adjusted to suit the conditions, i.e. depending upon the size of the closure and depending upon the toughness of the packing material used, the swivel angle can be selected. The reaction forces, which act when the lid 5 is swiveled on the swivel shafts of the lid 5 as well as of the guide 7, just press the swivel shafts 10, 11 in their respective bearing bushes, so that there is no risk of the swivel shafts slipping out of these bearing bushes 16, 17, which are open on one side.

Starting from the situation shown in FIG. 13, there is a further swiveling of the lid 5 owing to the tightened retracting band 9 with a simultaneous swiveling of the guide 7 downward in the same measure, so that finally the end position of the lid swiveling is reached, as shown in FIG. 14. Here the lid 5 is swiveled by about 120° and the guide 7 is also swiveled accordingly, whose downward swiveling started by 20° later, downward by 100° from the base element 1. Thus, in case of completely swiveled lid 5 the guide 7 holds the flap-shaped piece of the packing material cut downward, so that the passage remains free for the outflow. The swivel shafts 10, 11 and the related bearing bushes 16, 17 can be designed and dimensioned in such a way that they develop a certain frictional force, which sees to it that the lid 5 is held in the open or the swiveled position. If the lid 5 is swiveled close again, then the guide 7 remains in the swiveled down position. The retracting band 9 is simply pushed down. Upon swiveling again the lid 5, the guide 7, in case it has been swiveled back a little, is swiveled down again completely by the retracting band 9, in the position shown here. The sealing of the closure, so that not even a single drop can come out, is ensured by an elastic sealing lip 35, which is formed on the top 33 on the base element 1 and is pressed on the rear on to the smooth surface of the swivel shaft 10.

FIG. 15 shows a embodiment of a flap shutter with alternative forced-closure means 8, with the help of which the guide 7 can be swiveled down upto lid 5 in the counter-clockwise direction, upon opening the lid 5 with cutting or tearing and swiveling down the underlying packing piece. These forced closure means are made up in such a way that the swivel shafts 10, 11 form a gear rod over an axial section. For this, the swivel shafts 10, 11 of the lid 5 and the guide 7 at the base element 1 are schematically shown in a cross-section in this figure. The guide 7 with its swivel shaft 11 is set in the usual way from below in the bearing bushes at the base element 1. For this, the swivel shaft 11 is formed fulcrum pins at both its ends, which extend a little over the guide 7 on both the sides, whereas it is designed as gear rod in between i.e. over the entire width of the guide 7. The swivel shaft 10 of the lid 5 is similarly provided with fulcrum pins on both the sides, while it is provided with a cogging almost over the entire width of the lid 5 and forms a continuous gear rod. The guide 7 is set in the base element 1 from below and the lid 5 with its swivel shaft 10 is set in its bearing bushes at the base element 1 from the top. Because the U-shaped bearing bushes are arranged obliquely to the base element 1 can be arranged displaced only a little from each other, the cogging of the swivel shafts 11, 10 can be made to engage while setting the swivel shafts in the bearing bushes. If then the lid 5 at the base element 1 swiveled, then the torque acting at the swivel shaft 10 can be transferred to the swivel shaft 11 and thus to the guide 7 via the cogging; the guide 7 at the base element 1 can thus be made to swivel down accordingly with the same swivel force, with which the lid 5 is swiveled up, and can thereby tear the packing and push it further down. A large torque can therefore be applied, because the cogging is effective over the entire length of the swivel shaft.

FIG. 16 again shows an alternative embodiment of the just described variant with swivel shafts, which form a gear rod over an axial section, which enables a two-stage tearing and pushing down of the guide 7. For this, the swivel shafts 10, 11 of the lid 5 and of the guide 7 at the base element 1 are schematically displayed in a cross-section. The lower part of the lid 5 is now, as shown in the embodiments given in FIGS. 7 to 12, equipped with a retracting band 25 and the guide 7 with a front part 20 that can be swiveled away from it and a retracting band 22 formed at its bottom side. The retracting band is led through a recess 23 in the guide 7 on its top side and provided with a barbed hook 24. All elements are the same as in the case of a flap shutter, which is shown in the FIGS. 7 to 12, except the embodiment and the arrangement of the swivel shafts 11, 10 of the guide 7 and the lid 5. The guide 7 with its swivel shaft 11 is set in the usual way from below in the bearing bushes at the base element 1. For this, the swivel shaft 11 is formed fulcrum pins at both its ends, which extend a little over the guide 7 on both the sides, whereas it is designed as gear rod in between i.e. over the entire width of the guide 7. The swivel shaft 10 of the lid 5 is similarly provided with fulcrum pins on both the sides, while it is provided with a cogging almost over the entire width of the lid 5 and forms a continuous gear rod. Contrary to the embodiment given in FIG. 15, the cogging at the swivel shaft 10 of the lid 5 is only over a part of its periphery, as shown in FIG. 16. The lid 5 with its swivel shaft 10 is set in its bearing bushes at the base element 1 from the top. The swivel shaft 10 at the lid 5 then lies with an area vis-à-vis the swivel shaft 11 of the guide 7, where it does not show any cogging, but instead is blank. Only after the lid is swiveled by a certain angle of about 20° to 40°, i.e. after the retracting bands have come into action for the separate swiveling of the front part 20 of the guide, does the cogging at the swivel shaft 10 grip the cogging at the swivel shaft 11 and thereby effects a swiveling down of the guide 7 in the same measure when the lid 5 is swiveled up further.

FIG. 17 shows this solution with the lid 5 completely swiveled up. The cogs of the gear rod at the swivel shaft 10 of the lid 5 have engaged with those of the gear rod at the swivel shaft 11 of the guide 7 and this is swiveled downward by the swiveling up of the lid 5 in the counter-clockwise direction. Thereby, the longitudinal margins of the guide 7 have cut or ripped the underlying packing material and have further pushed down the strip of the packing material thus becoming free. When the lid 5 is closed, the guide 7 is swiveled back in its original position, and when the closure is opened again it is then swiveled down below again and again pushed down the strip cut or torn out of the packing material, thereby making the passage clear for the outflow of the liquid.

The force of friction active between the bolts of the swivel shafts 10, 11 and the bearing bushes make sure for these closures that the lid 5 is held in each swiveled position. Hence the closure can be opened and remain open, so that the combo packing can be held with one hand and its contents can be poured out in the desired quantity, while the other hand remains free or can hold some other vessel. If it is required with the free hand to insert a measuring spoon in the opening of the closure and to take out a measured part of the contents, it is important that the closure remains in its open position. This closure can also be closed again easily simply by swiveling back the lid 5 again on the base element 1. Thereby, the lid 5 can be designed in such a way that it rests fittingly on the base element 1 when it is swiveled down, i.e. its margin is somewhat projecting downward and on the top a slightly projecting margin can be bent on the base element 1. On its rear side, the sealing lip 35 presses at the smooth surface of the swivel shaft 10 and provides a very good sealing there. In case of the embodiment with the gear-rod sections on the swivel shafts, a sealing band can be provided, which connects the top side of the lid on the rear with the base element 1 and thus covers the cogged swivels shaft 10 of the lid 5 and is tight when the lid 5 is closed. Then the lid 5 is extruded with the base element 1 over this band and the guide 7 with its cogged swivel shaft 11 then forms the second plastic extruded-part of the closure.

FIG. 18 shows a variant, how the closure can be extruded as a single piece. For this, the base element is designed divided on its rear side and both the frame sets 44, 45 running backward are spread away somewhat, here namely by the angle of 43°. Both the pieces 46, 47 to be connected at the rear side of the base element show a clicking mechanism on the end side, for instance on the side with a barbed hook 42, which can click in a corresponding formation of the piece 46 lying on the opposite side. The lid 5 and the guide 7, which are connected with each other via the retracting band 9, are then extruded in the position shown here as one piece with the base element 1. For this, the ends of the swivel shafts 10, 11 are present directly before the openings of the bearing bushes and the outer margins of the front face of the swivel shafts are connected with the margins of the openings of the bearing bushes via several fine material bridges 41. The bearing bushes extend continuously through the frame 1 and open on the outside in the frame 1 with the holes 48, 49. Thereby, the bearing bushes can be deformed on the outside through slides, which retreat outward after the casting. The material bridges 41 give rise to, on one hand, the one-piece nature of the entire closure, and on the other the lid 5 and the guide 7 are positioned vis-à-vis the base element 1, so that a later positioning wit the help of a robot is omitted, which would be necessary in case of a separate casting of the base element 1 on one hand, and of the lid 5 with the guide 7 on the other. The only mounting step in this one-piece casting is that both the frame sides 44, 45 of the base element 1 are pressed together as shown in the direction of both the arrows lying on the opposite side. The fine material bridges 41 break thereby and the ends of the swivel shafts 10, 11 slip in the bearing bushes lying opposite to them. At the same time, both the pieces 46, 47 click together at the rear end of the base element 1 and in this way the closure is mounted and the swiveling of the lid 5 and the related swiveling of the guide 7 is ensured.

This closure is suitable not only for liquids, but also for all types of bulk materials. At all places, where substances are being packed in paper or plastic bags, such as flour, rice, corn, sugar, salt etc. the carton packing can now be used and this closure permits to open these packing in a simple, clean and safe way and to seal them again after use. In case a tamperproof closure is desired, then such a closure of the known type can be realized in a way such that the lid 5 is put over a lug at the base element 1 with a visible ring held over a breaking point the first time the closure is closed. Thereafter, it is possible to swivel the lid 5 only by breaking the break points, which results in a tamperproof seal, because it can be seen immediately at the closure, whether it has already been opened or not.

The invention claimed is:

1. A flap shutter for combo and carton packaging for automatic opening of a packing by opening a closure lid, comprising:

a frame base element having a flat bottom side for connecting with a combo or carton packing, said frame base element further including a peripheral projection projecting upwardly for forming an outflow support opening within said frame base element;

a lid connected to, and swiveling on, said frame base element for closing the outflow support opening formed by said frame base element and for opening and closing said frame base element;

a guide element capable of swiveling on said frame base element extends over an inner side of said peripheral projection with a swivel axis of said guide element running parallel to, and in front of, a swivel axis of said lid;

active forced-closure means located between said guide element and said lid for allowing said guide element to be swiveled downwardly by opening said lid for cutting, tearing or pushing downwardly a packing lying below said guide element in a swiveling direction opposite a swiveling direction of said lid in an automatic manner and without a user having to push downwardly with a finger of the user, so that when seen in a side view, said lid swivels in a first direction and said guide element swivels in a second direction, said second direction being a direction opposite said first direction.

2. The flap shutter for combo and carton packaging for automatic opening of a packing by opening a closure lid according to claim 1, wherein said lid is placed and held in a swiveling position on said frame base element via a first swivel shaft and said guide element is placed and held in a swiveled-down position on said frame base element via a second swivel shaft running parallel to a direction of a swivel region of said lid, said first swivel shaft and said second swivel shaft being formed with tilt plate bolts at their ends.

3. The flap shutter for combo and carton packaging for automatic opening of a packing by opening a closure lid according to claim 1, wherein said frame base element including inward projections formed on a side of said frame base element extending over said guide element for forming a stopper, so that said guide element is swivelable only downwardly from said frame base element.

4. The flap shutter for combo and carton packaging for automatic opening of a packing by opening a closure lid according to claim 1, wherein said frame base element includes bearing bushes formed by U-shaped projections, so that said bearing bushes are diagonally formed to a front side from below at said frame base element for attachment means of a swivel shaft of said guide element and said bearing bushes are diagonally formed to the front side from a top portion of said frame base element for attachment means of a swivel shaft of said lid behind said bearing bushes.

5. The flap shutter for combo and carton packaging for automatic opening of a packing by opening a closure lid according to claim 4, wherein said bearing bushes form hollow cylindrical boxes having cylinder walls extending by at least 180°.

6. The flap shutter for combo and carton packaging for automatic opening of a packing by opening a closure lid according to claim 1, wherein said lid is placed and held on said frame base element in a swiveled-up position via a first swivel shaft and said guide element is placed and held in a swiveled-down position on said frame base element via a second swivel shaft running parallel to a direction of a swivel region of said lid.

7. The flap shutter for combo and carton packaging for automatic opening of a packing by opening a closure lid according to claim 6, wherein said active forced-closure means comprise a retracting band running from a bottom side of said guide element around said second swivel shaft at said guide element and connected to a bottom side of said lid.

8. The flap shutter for combo and carton packaging for automatic opening of a packing by opening a closure lid according to claim 6, wherein said lid has a top side that tangentially merges in said first swivel shaft and said guide element has a top side that tangentially merges in said second swivel shaft, so that a bottom side of said lid lies substantially on a top side of said guide element in a swiveled-down mode on said base element, and a marginal region of said guide element forms a blade projecting downwardly, so that a downwardly projecting piercing tip is formed at a tip of said guide element.

* * * * *